US007383016B2

(12) United States Patent
Lee et al.

(10) Patent No.: US 7,383,016 B2
(45) Date of Patent: Jun. 3, 2008

(54) ELECTROPHOTOGRAPHIC DEVICE CAPABLE OF PERFORMING AN IMAGING OPERATION AND A FUSING OPERATION AT DIFFERENT SPEEDS

(75) Inventors: Adrian J. Lee, Chatham, IL (US); Peter B. Pickett, Lexington, KY (US); David A. Schneider, Lexington, KY (US); John P. Spicer, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 342 days.

(21) Appl. No.: 11/234,363

(22) Filed: Sep. 23, 2005

(65) Prior Publication Data

US 2007/0071529 A1 Mar. 29, 2007

(51) Int. Cl.
*G03G 15/00* (2006.01)

(52) U.S. Cl. ..... 399/400; 399/396; 399/397; 399/401; 399/405; 271/69; 271/202; 271/203; 400/625

(58) Field of Classification Search ..... 399/396, 399/397, 400, 401, 405; 271/69, 202, 203; 400/625

See application file for complete search history.

(56) References Cited

U.S. PATENT DOCUMENTS 4,561,756 A 12/1985 Lang
4,745,435 A * 5/1988 Sakata et al. ..... 399/322
5,170,215 A 12/1992 Pfeuffer
5,254,165 A * 10/1993 Haruna ..... 118/60
5,274,428 A 12/1993 Wong et al.
5,329,338 A 7/1994 Merz et al.
5,508,789 A 4/1996 Castelli et al.
5,548,388 A 8/1996 Schieck
6,254,081 B1 * 7/2001 Rasmussen et al. ..... 271/96
6,259,880 B1 7/2001 Jia et al.
6,327,458 B1 12/2001 Chapman
6,370,354 B1 4/2002 Chapman et al.
6,393,245 B1 5/2002 Jia et al.
6,519,443 B1 2/2003 Coriale et al.
6,556,798 B2 4/2003 Rimai et al.
6,681,094 B2 6/2004 Horrall et al.
2003/0068179 A1 4/2003 Horrall et al.

* cited by examiner

*Primary Examiner*—Ren Yan
*Assistant Examiner*—Andy L Pham
(74) *Attorney, Agent, or Firm*—Stevens & Showalter, LLP

(57) ABSTRACT

An electrophotographic imaging device comprises generally, an image transfer station configured to transfer a toned image to a substrate, a fuser assembly configured to fuse the toned image to the substrate and a transport device configured to transfer the substrate from the image transfer station to the fuser assembly. The device further includes a controller for controlling a first process rate of the image transfer device and a second process rate of the transport device. The controller has a mode of operation wherein the first process rate is different from the second process rate when a hand off is performed to pass the substrate from the image transfer station to the transport device.

20 Claims, 5 Drawing Sheets

ELECTROPHOTOGRAPHIC DEVICE CAPABLE OF PERFORMING AN IMAGING OPERATION AND A FUSING OPERATION AT DIFFERENT SPEEDS

BACKGROUND OF THE INVENTION

The present invention relates in general to an electrophotographic imaging apparatus and in particular to an electrophotographic apparatus capable of performing a printing operation wherein an electrophotographic imaging operation and a fusing operation are performed at different speeds.

In electrophotography, a latent image is created on an electrostatically charged photoconductive surface, e.g., a photoconductive drum, by exposing select portions of the photoconductive surface to laser light. Essentially, the density of the electrostatic charge on the photoconductive surface is altered in areas exposed to a laser beam relative to those areas unexposed to the laser beam. The latent electrostatic image thus created is developed into a visible image by exposing the photoconductive surface to toner, which contains pigment components and thermoplastic components. When so exposed, the toner is attracted to the photoconductive surface in a manner that corresponds to the electrostatic density altered by the laser beam. The toner pattern is subsequently transferred from the photoconductive surface to the surface of a print medium, such as paper, which has been given an electrostatic charge opposite that of the toner.

A fuser then applies heat and pressure to the print medium before it is discharged from the apparatus. The applied heat causes constituents including the thermoplastic components of the toner to flow into the interstices between the fibers of the medium and the pressure promotes settling of the toner constituents in these voids. As the toner is cooled, it solidifies and adheres the image to the medium.

Fusing requirements may be more stringent when printing onto certain substrate types such as transparencies, compared to plain paper. For example, to produce good quality color transparencies, the un-fused opaque color toner components must be transparentized, which requires that all of the toner be adequately fused to the substrate. Also, more energy is required to fuse multiple layers of toner, e.g., for color printing, compared to fusing a single layer of toner, such as for monochrome printing because the fuser is required to fuse a much higher toner mass/area ratio. The fuser nip must also heat up the toner to a point that it flows on the surface of the transparency creating a smoothed substrate surface. The smoothed surface minimizes surface defects that can scatter light, making the image appear "dirty" or out of focus. Moreover, the smoothed surface allows light to transmit through the transparency and toner layer with very little diffusion. To address the above issues, fusing operations for transparencies generally require longer resident times of the substrate in the fuser compared to fusing operations for plain paper.

Color printers are typically optimized for printing at the highest operational speed. Unfortunately, the wide variation between the fastest print speed and the lower, optimal transparency print speed can cause motion quality artifacts in the electrophotographic operations formed at the lower speed, e.g., due to rotational velocity instability such as wow and flutter caused by operation of the electrophotographic motor at a non-optimized speed. In this regard, motors may be configured to tolerate relatively wide speed ranges using relatively complicated, multi-speed gearboxes to change the gear ratio when switching from high speed to low speed print jobs so that the motor operates within designed-for speed ranges. However, such a solution adds considerable cost, bulk and complexity to the system design.

Alternatively, a transfer device may be used as an intermediary to handoff the print medium, e.g., a transparency, from an image forming assembly to a fuser assembly. Under this configuration, the transfer device and the fuser assembly are both typically operated by a common fuser motor. Essentially, the image forming assembly is operated at a first, relatively high speed. The transfer device and the fuser assembly are ramped up to the first operating speed to accept a first handoff of the transparency from the image forming assembly to the transfer device. Once the transparency has cleared the transfer from the image forming assembly onto the transfer device, the operating speed of the transfer device and the fuser assembly are ramped down to a second, relatively slower speed that is optimal for fusing operations before a second handoff of the transparency from the transfer device to the fuser.

However, the above-described use of an intermediary increases the required inter-page gap between successive sheets thus reducing overall throughput of the electrophotographic device because the fuser motor speed, which also controls the transfer device, can not be ramped back up to the first speed until the trailing edge of the leading transparency has completely cleared the fuser nip. The result is that the overall print speed for transparencies is actually less than the optimized transparency fuser speed. For example, a printer may realize an output rate for transparencies of 6-7 pages per minute despite having the capability of operating at a fusing rate of approximately 10 pages per minute because the inter-page gap between successive transparencies must be increased to accommodate the time required for ramping up the transfer device for the first handoff and subsequently slowing down the transfer device for the second handoff.

Further, the image forming assembly of a conventional printer typically comprises a toner cartridge having a developer roll that turns against a corresponding photoconductive drum to supply the drum with toner. Toner is stripped off the developer roll and is recycled back to the cartridge if such toner is not transferred to the drum surface as the drum and developer roll rotate. However, repeated recycling or churning of the toner begins to strip electrophotographic additives from the toner, thus decreasing the useful life of the toner particles. The drum and the developer roll typically rotate during an entire printing operation, including the time required to ramp up and ramp down the transfer device, e.g., when printing transparencies as noted above. During such ramp up and ramp down times, the drum is not printing, e.g., directly onto a print medium or an intermediate transfer member belt, and is not removing toner from the developer roll, thus increasing the amount of toner churn.

SUMMARY OF THE INVENTION

According to an embodiment of the present invention, an electrophotographic imaging device comprises an imaging apparatus, a fuser assembly, a transport device and a controller. The imaging apparatus forms a toned image on a substrate and includes an image transfer station for transferring the toned image from at least one image bearing member, such as one or more photoconductive surfaces and/or an electrically charged transfer belt, to the substrate. The fuser assembly is configured to fuse the toned image to the substrate, and the transport device is configured to transport the substrate from the image transfer station to the fuser assembly. The controller has a first mode of operation where the image transfer station is controlled to operate at a first speed of operation and the transport device is controlled to operate at a second speed of operation where the first speed of operation of the image transfer station is different from the second speed of operation of the transport device when a hand off is performed to pass the substrate from the image transfer station to the transport device.

According to another embodiment of the present invention, an arrangement for transporting a toned image on a substrate to a fuser assembly in an electrophotographic device comprises an image transfer station, a fuser assembly, a transport device and a controller. The image transfer station transfers a toned image to a substrate at a first process rate. The fuser assembly is configured to fuse the toned image to the substrate, and a transport device is configured to transport the substrate from the image transfer station to the fuser assembly at a second process rate. The controller controls the first process rate of the image transfer device and the second process rate of the transport device and is operable in a first mode of operation wherein the first process rate is different from the second process rate when a hand off is performed to pass the substrate from the image transfer station to the transport device.

According to yet another embodiment of the present invention, a method of operating an electrophotographic imaging device comprises operating an image transfer station at a first process rate to transfer a toned image to a substrate, operating a fuser assembly to fuse the toned image to the substrate, operating a transport device at a second process rate to transfer the substrate from the image transfer station to the fuser assembly and operating in a select one of at least two modes of operation, wherein the first process rate is different from the second process rate while a hand off is performed to pass the substrate from the image transfer station to the transport device when operating in a first one of the at least two modes of operation.

BRIEF DESCRIPTION OF THE DRAWINGS

The following description of the preferred embodiments of the present invention can be best understood when read in conjunction with the following drawings, where like structure is indicated with like reference numerals, and in which.

DETAILED DESCRIPTION

In the following description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
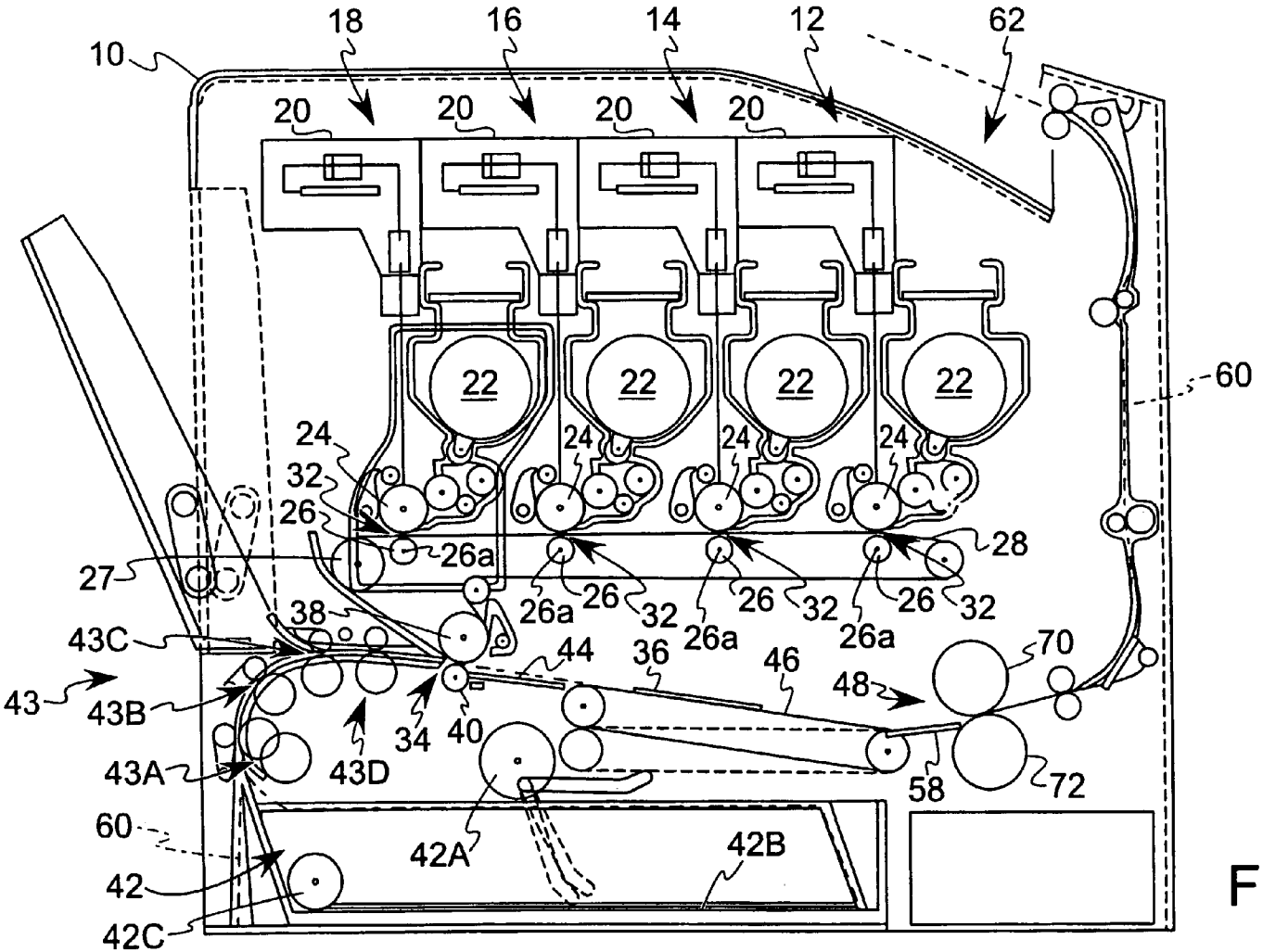
FIG. 1 is a side view of an exemplary color electrophotographic (EP) printer.

Referring now to the drawings, and particularly to FIG. 1, an exemplary color electrophotographic (EP) printer 10 includes four image forming stations 12, 14, 16, 18 that are controllable to form yellow (Y), cyan (C), magenta (M) and black (K) toner images respectively. Each image forming station 12, 14, 16 and 18 includes a laser printhead 20, a toner cartridge 22 and a rotatable photoconductive (PC) drum 24.

During an imaging operation, each printhead 20 generates a scanning laser beam that is modulated according to image data from an associated one of the yellow, cyan, magenta and black image planes to write a latent image onto the corresponding PC drum 24, such as by selectively dissipating a previously charged photoconductive surface of the PC drum 24. During an image development operation, each toner cartridge 22 provides electrically charged toner particles to its associated PC drum 24. The charged toner particles adhere to the discharged areas on the PC drum 24 thus developing the latent image written by the associated printhead 20 to a toned image with a corresponding one of cyan, magenta, yellow or black toner.

The printer 10 also includes four electrically biased transfer rollers 26. Each transfer roller 26 is positioned so as to oppose an associated one of the PC drums 24. A high voltage power supply (not shown) is electrically connected to each transfer roller 26, e.g., via a transfer roller shaft 26A, to apply a voltage to the transfer roller 26 opposite in polarity to the charge on the toner. For purposes of discussion herein, the four PC drums 24 and their corresponding transfer rollers 26 shall be referred to collectively as a first image transfer station 32.

An image transfer device, which is implemented as an intermediate transfer member (ITM) belt 28 in FIG. 1, travels in an endless loop between the PC drums 24 and the transfer rollers 26, around a drive roll 27 and through a nip formed at a second image transfer station 34. During an electrically biased roll transfer operation, the charge on each of the transfer rollers 26 causes the toned images on the PC drums 24 to transfer to the ITM belt 28 as the ITM belt 28 passes through the nips defined between each PC drum 24 and its corresponding transfer roller 26.

Figure 2:
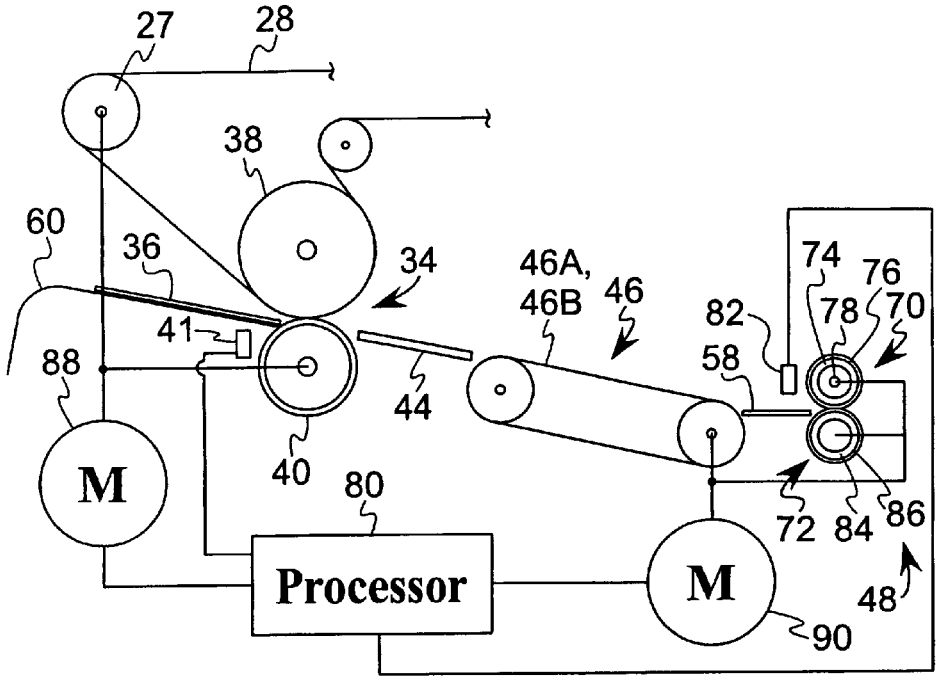
FIG. 2 is a schematic view of a section of the EP printer of FIG. 1, illustrating the use of a first motor to control an image process rate and a second motor to control a fusing rate during a printing operation.

The second image transfer station 34 is provided to transfer a mono or composite toned image from the ITM belt 28 to a print substrate 36, which may comprise for example, paper, cardstock, labels, transparencies and other printable media. The second image transfer station 34 includes a backup roller 38 that is positioned on the inside of the ITM belt 28, and a transfer roller 40 that is positioned opposite the backup roller 38 as seen in FIGS. 1 and 2. Substrates 36 are fed from a substrate supply 42 to the second image transfer station 34 by a pick mechanism 42A that draws a top sheet from a substrate supply tray 42B and by a speed compensation assembly 43 discussed below, so as to register the substrate 36 with the mono or composite toned image on the ITM belt 28. A substrate 36 is fed to the second image transfer station 34 such that its velocity is substantially matched to the linear velocity of the ITM belt 28 and transfer roller 40. The backup roller 38 at the second image transfer station 34 may comprise for example, an uncoated metal roller such as nickel-plated aluminum. The transfer roller 40 may comprise a foam roll such as urethane foam that has a conductive agent such as an ionic salt.

In the exemplary printer 10, the four image forming stations 12, 14, 16, 18, the ITM belt 28, the first image transfer station 32, and the second image transfer station 34 cooperate to define an imaging apparatus for forming a toned image on the substrate 36. However, other suitable imaging apparatus configurations may be implemented. For example, in the illustrated imaging apparatus, the four PC drums 24 and the ITM belt 28 act as image bearing members that can transfer toner images. However, other image bearing member configurations may be implemented, such as one or more photoconductive drums, belts or other photoreceptive surfaces, with or without one or more electrically charged transfer belts or other suitable toner image transfer structures. Moreover, the second image transfer station 34 may comprise other suitable structures, an example of which includes a belt that transports a print substrate directly past one or more image bearing members such as photoconductive drums or other photoconductive surfaces. Additionally, in the illustrative example, the ITM belt 28 functions both as an image bearing member and an image transfer device as the ITM belt 28 functions to carry images from the four PC drums 24 to the second image transfer station 34.

The pick mechanism 42A comprises an arm having a pair of drive rolls 42C that rest on top of a substrate stack provided in the substrate supply tray 42B. A pick motor (not shown) is provided for driving the drive rolls 42C to direct a top sheet from the substrate stack into the substrate path 60. As a substrate 36 exits the substrate supply 42 along the substrate path 60, it enters the speed compensation assembly 43. The speed compensation assembly 43 comprises four drive roller sets 43A-43D, which are spaced apart along a curved portion of the substrate path 60. The four drive roller sets 43A-43D are driven by a registration motor (not shown), which controls the operation of the four drive roller sets 43A-43D such that the substrate 36 picked from the substrate stack is delivered to the nip at the second image transfer station 34 so as to register with a corresponding toned image on the ITM belt 28. The operation of the pick and registration motors may be controlled via a processor 80, which is best seen in FIG. 2.

Referring to FIG. 2, during a print operation, the substrate 36 travels along the substrate path 60 towards the second image transfer station 34 and is detected by a substrate sensing device 41 that is upstream of a transport device, which is implemented as a media transport belt assembly 46 as illustrated. For example, the substrate sensing device 41 may be located at a point between the speed compensation assembly 43 and the nip of the second image transfer station 34. The substrate sensing device 41 may be implemented in any practical manner, an example of which includes a position sensor, such as an edge detecting flag, which detects a leading edge of the substrate 36. Based upon the known travel speed of the substrate 36 along the substrate path 60 and the location of the position sensing device 41, e.g., the distance from the position sensing device 41 to the nip of the second image transfer station 34, the timing and location of the substrate 36 along the paper path can be computed. For example, the output of the substrate sensing device 41 may be used to estimate or otherwise determine when the substrate 36 will enter the nip of the second image transfer station 34.

The substrate 36 exits the second image transfer station 34 via a transfer nip defined by rollers 38 and 40 onto a media guide plate 44. High electrostatic forces can cause the substrate 36 to attach and/or stick to the media guide plate 44, which would then generate a paper jam. Since the substrate 36 may retain an electrostatic charge after exiting the second transfer station 34, the media guide plate 44 may be grounded to bleed off the charge on the substrate. Under this arrangement, the media guide plate 44 may be constructed of a resistive polycarbonate and may be electrically grounded. Alternatively, a grounded discharge brush (not shown) may be provided so as to relieve the substrate 36 of any excessive residual charge. The optional brush may comprise for example, stainless steel, carbon-loaded nylon, or carbon-loaded polyester fibers. However, the particular configuration of the media guide plate 44 will likely vary depending on the specific requirements of a given apparatus. The media guide plate 44 directs the substrate 36 from the second image transfer station 34 to the media transport belt assembly 46 that carries the substrate 36 to a fuser assembly 48. In the illustrated embodiment, the media transport belt assembly 46 comprises two belts 46A, 46B. However, other suitable belt arrangements may be implemented.

Horizontal transfer of the substrate 36 out of the second image transfer station 34 may result in an undesirable upward trajectory as the substrate 36 exits the nip. For example, electrostatic fields within the printer 10 may cause the substrate 36 to steer too far from the discharge brush on the media guide plate 44 to be effectively discharged. The substrate 36 may also be positioned too far from the media guide plate 44 to be suitably held down on the media transport belts 46A, 46B. Accordingly, the second image transfer station 34 may be configured so that the substrate 36 exits to the media guide plate 44 at a downward angle, e.g., approximately −10 to −15 degrees to the horizontal. The particular angle will depend upon factors such as the relative stiffness of the transfer roller 40 and the characteristics of the anticipated substrates 36.

Figure 3:
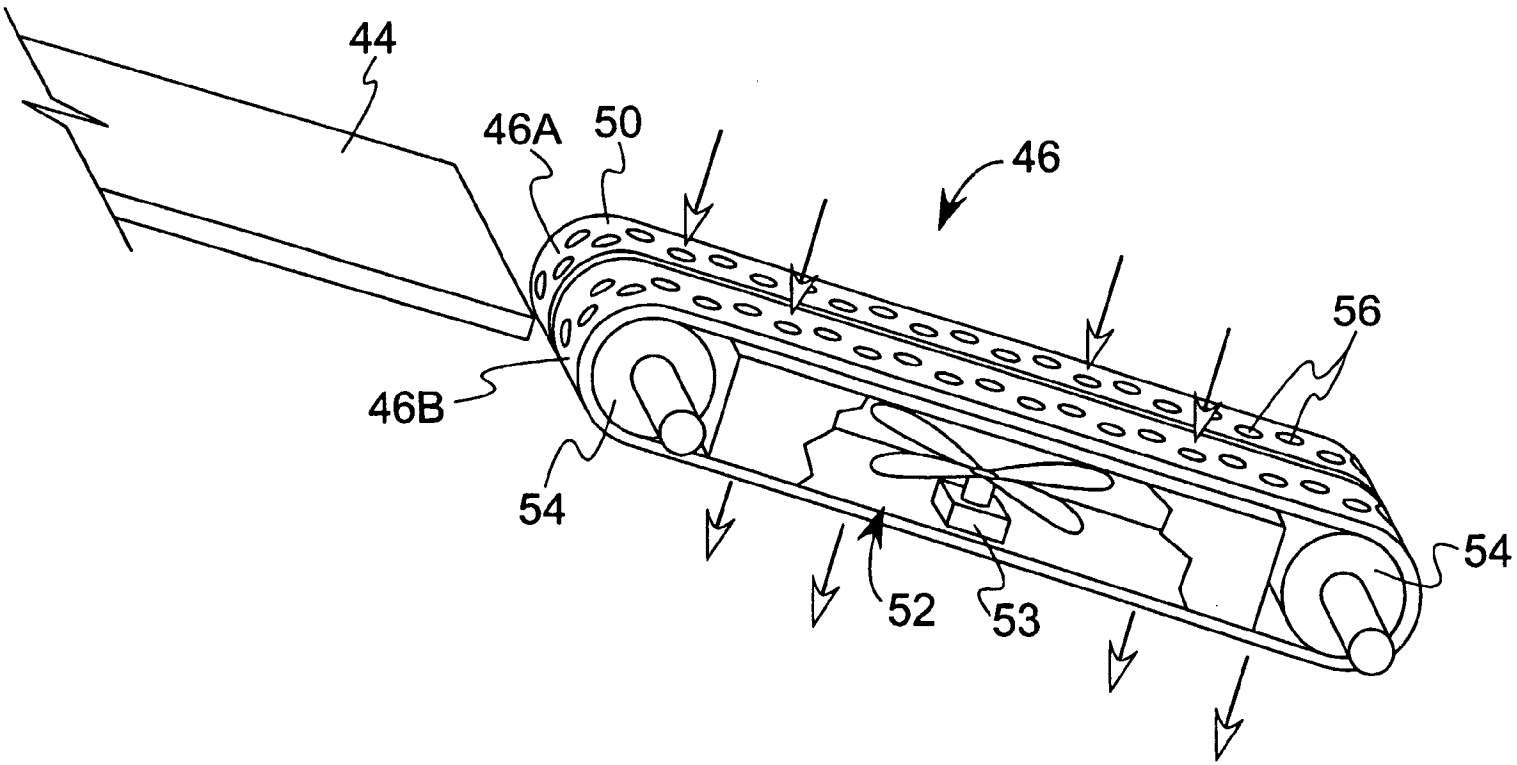
FIG. 3 is a schematic illustration of a media transport belt assembly of the EP printer of FIG. 1.

With reference to FIG. 3, each of the media transport belts 46A, 46B may comprise, as an example, a carbon-loaded Ethylene Propylene Diene Monomer (EPDM) or other resistive polymer belt. The media transport belts 46A, 46B are provided with a ground path by a scrubbing contact to an underlying grounded vacuum plenum 52 or alternately by one of the conductive drive rolls 54 that drive the media transport belts 46A, 46B. As noted above, the electrostatic charge on the substrate 36 may have been at least partially bled off, e.g., by the media guide plate 44. This reduces the electrostatic hold-down forces so that the substrate 36 may be held to the media transport belts 46A, 46B by a vacuum derived from the plenum 52. Where a vacuum force is provided, such as using the plenum 52, the media transport belts 46A, 46B may be provided with apertures 56 through the belt material that allow the air to draw the substrate 36 to the belts 46A, 46B.

With reference back to FIGS. 1 and 2, the media transport belt assembly 46 is provided in the printer 10 because the distance from the nip of the second image transfer station 34 to the fuser assembly 48 is greater than the length of the shortest intended substrate 36. In certain implementations, the media transport belt assembly 46 may be required to transport the substrate 36 over a relatively long distance, e.g., approximately 320 millimeters, which is greater than a regular A4 and letter sized page but less than a legal page in length. Thereafter, the toned substrate 36 passes through a fuser assembly 48.

The fuser assembly 48 provides energy in the form of heat to the substrate 36, which causes the toned image on the substrate 36 to melt. Thus, the fuser assembly 48 typically includes an electrical design capable of handling the toned and at least partially charged substrate 36 without disturbing the toned image thereon. When the toner subsequently cools, it solidifies and adheres to the substrate 36. A short guide plate 58 may be used to bridge the gap between the media transport belt assembly 46 and the entrance to the fuser assembly 48. The guide plate 58 may be resistive and electrically grounded, however such electrical characteristics are not required. The substrate 36 including the fused toner image continues along the substrate path 60, which is schematically shown by a dashed line, until the substrate 36 exits the printer 10 into an exit tray 62.

With specific reference to FIG. 2, the exemplary illustrated fuser assembly 48 includes a fuser hot roller 70 defining a heating member, and a fuser backup roller 72 defining a backup member. During a fusing operation, the substrate 36 passes between a nip formed between the hot roller 70 and the corresponding backup roller 72. The hot roller 70 may comprise for example, a hollow aluminum core member 74 covered with a thermally conductive elastomeric material layer 76. Under this arrangement, a heater element 78, such as a tungsten-filament heater, is located inside the core member 74 of the hot roller 70 for providing heat energy to the hot roller 70 under control of a print engine controller, such as may be implemented by the processor 80. In addition, a temperature sensor 82 is provided and may engage the hot roller 70 for sensing the temperature of the hot roller 70 and for sending a corresponding signal to the processor 80.

The backup roller 72 may comprise, for example, a hollow aluminum core member 84 covered with a thermally non-conductive elastomeric material layer 86. In the illustrated embodiment, the backup roller 72 does not include a heater element. Both the hot and backup rollers 70 and 72 may include a PFA (polyperfluoroalkoxy-tetrafluoroethylene) sleeve (not shown) around their elastomeric material layers 76, 86. The fuser assembly 48 may alternatively comprise a heated belt and a corresponding backup member, a heated fuser roll and a backup member such as a belt, or other heated nip forming structures.

Multiple Speed Operation

In general, the speed at which the substrate 36 is printed is affected by the operational rate of the various components and assemblies along the substrate path 60 of the printer 10. Additionally, delays may be introduced to accommodate warm up of the fuser assembly 48, initiation or recalibration of printer electronics, inter-page gap delay between successive pages of a larger print job or other printer functions.

A first process rate, also referred to herein as an image process rate, refers to a speed in which a toned image is transferred from an image transfer station to a print substrate 36, e.g., the rate at which the toned image is transferred to the substrate 36 at the nip of the second image transfer station 34. Typically, the rate of travel of the substrates 36 along the substrate path 60 from the substrate supply 42 or other input device to the image transfer point, e.g., the nip of the second image transfer station 34, is the same as the image process rate. A second process rate refers to a rate at which the substrates 36 are advanced by the media transport belt assembly 46 and/or are moved through the fuser assembly 48. The second process rate may also be referred to as a fusing rate when referred to in the context of fusing by the fuser assembly 48.

Figure 4:
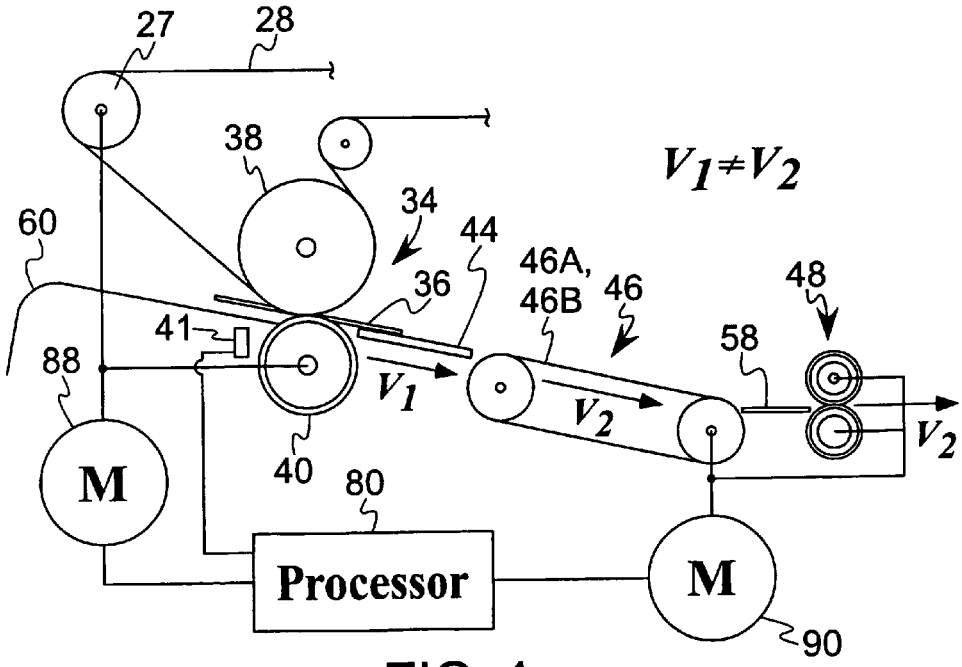
FIG. 4 is a schematic view of a section of the EP printer of FIG. 1, illustrating a speed of a substrate that exits a nip of an image transfer station.

With reference to FIG. 4, a first drive source, such as a first motor 88, also referred to herein as a drive motor, is configured to drive the ITM belt 28. As illustrated, the first motor 88 is coupled to the drive roller 27 and the transfer roller 40, e.g. by suitable gear mechanisms. The drive roller 27 causes the ITM belt 28 to rotate, thus rotating the backup roller 38 at the nip of the second image transfer station 34. However other drive configurations may be implemented to cause the ITM belt 28 to rotate. The speed of the first motor 88 is controlled, e.g., by the controller 80, to correspond with the desired image process rate. A second drive source, such as a second motor 90, is coupled to the hot and backup rollers 70, 72 of the fuser assembly 48. The speed of the second motor 90 is controlled, e.g., by the controller 80, to correspond with the desired fusing rate.

If the linear speed of the substrate 36 on the media transport belt assembly 46 is faster than the linear speed of that substrate 36 passing through the nip of the fuser assembly 48, the substrate 36 may buckle and the substrate surface can contact non-functioning machine surfaces, smearing the toner. If the linear speed of the substrate 36 on the media transport belt assembly 46 is slower than the linear speed of that substrate 36 passing through the nip of the fuser assembly 48, the image can be smeared either in the nip of the second image transfer station 34 or the nip of the fuser assembly 48. As such, the second motor 90 may also be coupled to drive the media transport belt assembly 46 such that the second process rate is the same for both the media transport belt assembly 46 and the fuser assembly 48. Other arrangements may alternatively be provided to adjust or otherwise regulate the first and/or second process rates. Moreover, each of the first and second motors 88, 90 is illustrated schematically as being controlled by the processor 80. However, other motor control arrangements, including the use of separate motor controllers may alternatively be implemented.

The first and second motors 88, 90 are each coupled to appropriate gearing, drive take-offs and torque arrangements as the application dictates. Also, the first and second motors 88, 90 may be of any convenient type, e.g., a stepping motor, brush or a brushless DC motor. Brushless DC motors are typically a convenient option to integrate with speed measuring devices such as hall-effect sensors and encoder arrangements such as frequency generated feedback pulses that present measurements of motor shaft angular displacement. Such speed measuring devices may be integrated with a phase locked loop other suitable control logic to control the motor so as to maintain a substantially constant velocity.

Split Speed Operation

It may be desirable in certain electrophotographic devices to provide two or more print speeds to support different modes of operation. For example, when printing on plain paper, it may be desirable to operate the printer at a first speed, which is a relatively fast throughput speed. However, relatively slower fusing rates may be required for certain applications. For example, slower fusing rates may be required to achieve translucence of color toners fused onto transparent substrates, or improve adherence of toner when printing thick, gloss or specialty papers.

According to an embodiment of the present invention, the second image transfer station 34, the media transport belt assembly 46 and the fuser assembly 48 are controlled by the processor 80 such that a handoff from the second image transfer station 34 to the media transport belt assembly 46 occurs at a speed mismatch. This allows, for example, the image process rate to be executed at a first, relatively fast rate, and the fusing rate to be executed at a second, relatively slower rate. It is also possible to operate the printer 10 such that the image process rate is executed at a rate slower than the fusing rate, e.g., to achieve a faster first page output, depending upon the substrate type and printing requirements.

As illustrated in FIG. 4, the nip of the second image transfer station 34 is operated at an image process rate corresponding to a first speed of operation of the second image transfer station, which is designated as V1, e.g., 20 pages per minute. Thus, the substrate 36 exits the nip of the second image transfer station 34 at the first speed V1. However, the media transport belt assembly 46 and the fuser assembly 48 are operated at a second process rate corresponding to a second speed of operation, which is designated as V2, e.g., 10 pages per minute.

Figure 5:
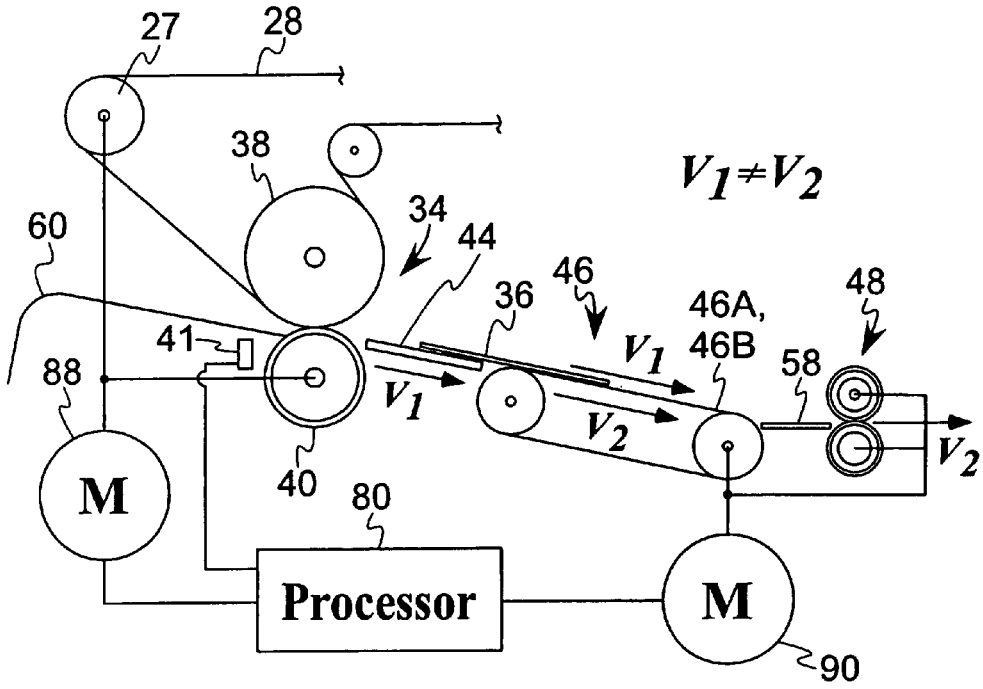
FIG. 5 is a schematic view of a section of the EP printer of FIG. 1, illustrating a speed of a substrate that is slipped by a nip of an image transfer station over a media transport belt assembly.

Referring to FIG. 5, the substrate 36 extends over and onto the media transport belt assembly 46 at the first speed V1 until the substrate 36 has left the nip area of the second image transfer station 34. However, the media transport belt assembly 46 and the fuser assembly 48 are controlled to operate at the second speed V2, which is less than the speed V1 in the present example. As such, there is a speed mismatch between the substrate 36 and the media transport belt assembly 46, at least until the substrate 36 has completely exited the nip area of the second image transfer station 34. As described in greater detail below, the attraction force of the media transport belt assembly 46, e.g., the vacuum of the plenum 52 (best seen in FIG. 3), is controlled by the processor 80 so as to allow the substrate 36 to slip over the belt surface 50 of the media transport belts 46A, 46B, which are discussed below. The specific control of the attraction force will depend upon the media type of the substrate 36. For example, the use of a relatively slow fusing speed is typically required by specialty substrates such as transparencies, cardstock, etc. Such materials often exhibit a high beam strength that assists in the effectiveness of the substrate 36 to slip over the belt surface 50. Moreover, the attraction force may be sufficient to stop the substrate from slipping over the belt surface 50 before the substrate 36 enters the nip of the fuser assembly 48.

Figure 6:
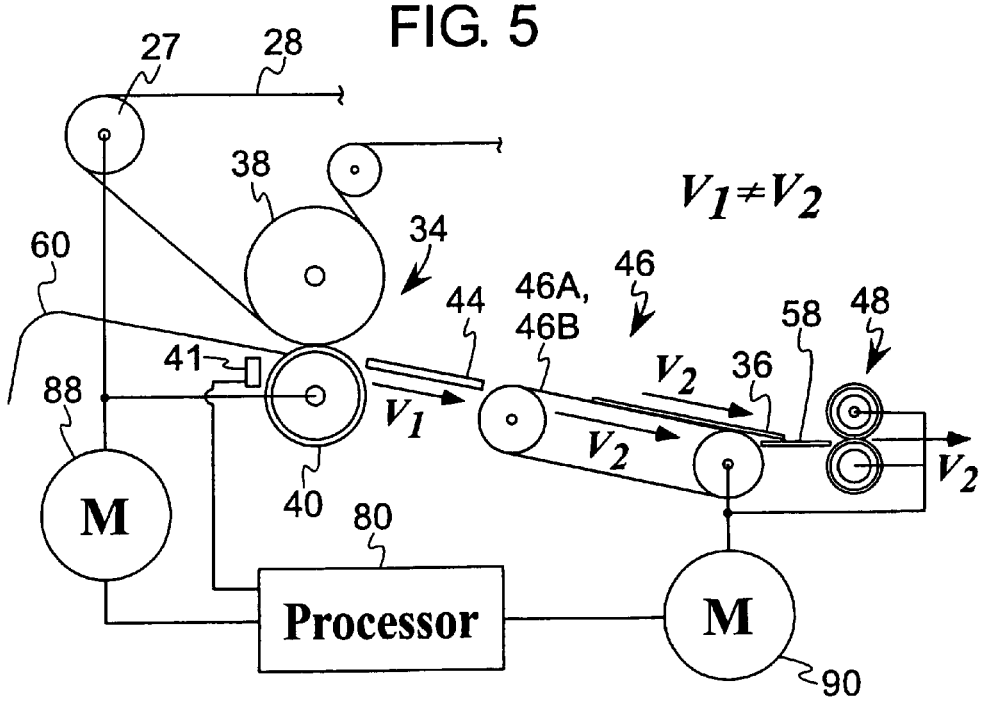
FIG. 6 is a schematic view of a section of the EP printer of FIG. 1, illustrating a speed of a substrate at the nip entrance to the fuser assembly.

Referring to FIG. 6, once the substrate 36 has exited the nip of the second image transfer station 34, the substrate is altered to the second speed V2 such as by the attraction force of the vacuum plenum 52 provided in cooperation with the media transport belt assembly 46. The speed of the substrate 36 is maintained at the second speed V2 for the fusing operation at the fuser assembly 48.

Because of the speed difference between the substrate 36 and the linear velocity of the media transfer belts 46A, B at the handoff between the second image transfer station 34 and the media transport belt assembly 46, the inter-page gap must be adjusted to correspond to the overall time required for the substrate 36 to pass through the printer 10. This inter-page gap is effected by modifying the time period between when successive substrates 36 are picked from the substrate supply tray 42B. The modified inter-page gap is maintained by the processor 80 until the print operation has been completed. By modifying the inter-page gap, an appropriate fusing operation can be performed while still maintaining relatively faster imaging operations. For example, if the image process rate is 20 pages per minute and the fusing rate is 10 pages per minute, the pick mechanism 42A is controlled to pick a new substrate at a rate of 10 pages per minute. This is seen conceptually, for example, by operating at an image process rate of 20 pages per minute, and by instructing the pick mechanism 42A to skip every other page, netting a 10 page per minute throughput.

As noted above, the first and second motors 88, 90 may be implemented as brushless DC motors. Under such an arrangement, the use of encoder feedback for motor control is typically optimized for operation over a limited range of speeds. For example, if a DC brushless motor is optimized for a relatively high print speed, frequency generated feedback pulses or other speed feedback information is received relatively quickly, and a feedback control time constant is set to a value corresponding to the relatively fast speed. However, when the DC brushless motor is slowed down to a relatively slow speed, the feedback information is correspondingly generated relatively more slowly. However, the feedback time constant is still optimized for relatively fast operating speed. As such, the motor may exhibit wow, flutter and other characteristics that affect the rotational velocity of the motor due to the rate of feedback and dynamic response of the system.

Moreover, even if the first motor 88 can be suitably operated over a wide range of speed values, it is possible that the image process rate can be limited by other components and component assemblies of the printer 10 including the imaging electronics. For example, when slowing down the image process rate, either the laser output power, the rotational velocity of the polygon mirror, or both may require adjustment to compensate for the new image process rate. However, a typical laser diode is not always adjustable to accommodate large variations in laser output power. For example, laser power adjustments over a wide range may result in spurious mode-hopping as the laser current approaches the laser power threshold for lasing. Also, relatively large changes in laser power can affect the overall print quality due to changes in laser turn-on and turn-off timing. Relatively large variations in polygon motor velocity can also affect print quality, such as by causing jitter and otherwise unstable rotational velocity of the polygon mirror. Still further, the range of speeds suitable for operating the speed compensator assembly 43, which registers the substrate with the toned image on the ITM belt 28 at the nip of the second image forming station 34 may limit the overall range of image process rates.

Accordingly, it may be desirable to drive the first motor 88 within a limited range of speeds. In one exemplary embodiment, the first motor control logic is optimized for a designed-for maximum speed, e.g., 40 pages per minute. Moreover, the first motor 88 is controlled by the processor 80 to operate at the maximum speed, or at a speed reduction of approximately 3:1 or less. However, the range of speeds ma vary over any other reasonable range, depending upon the components of the particular printer. Thus, the operating range of various motors, imaging system electronics, paper path and registration controls, and/or the maximum fusing rate for certain media types such as transparencies and other heavy cardstock may define limiting factors to the speed at which the printer 10 may be operated. However, according to an embodiment of the present invention, many such speed limitations can be overcome.

Current print speeds can meet and exceed speeds of 35-40 pages per minute. However, fusing operations for color transparencies may operate at approximately a 10 page per minute maximum threshold. Thus, the first and second motors 88, 90 would typically be required to operate over a speed range of approximately 3.5:1 to 4:1. If the first motor 88 is slowed down so that the image process rate equals the 10 page per minute fusing rate required for transparencies and other specialty paper, then motion quality artifacts can result in the toner deposited on the substrate 36 when imaged at the lower speeds. For example, as noted in greater detail herein, imaging electronics can introduce artifacts in the latent images written to the PC drums 24 and/or the first motor 88 may introduce rotational velocity instability such as wow and flutter which could affect the placement of unfused toner from the PC drums 24 onto the ITM belt 28, and/or from the ITM belt 28 to the substrate 36 at the second image transfer station 34.

According to an embodiment of the present invention, the need for operating the first motor 88 for image processing over a wide speed range is overcome since the image transfer process may be executed at a first, relatively higher speed that falls within the optimized and/or acceptable range of operating speed for the imaging components of the printer 10, while the second motor operates the fuser assembly 48 at a slower speed suitable for fusing transparencies or other substrates that benefit from slower fuser speeds. The handoff at the second image transfer station 34 and the media transport belt assembly 46 occurs with a speed difference. In this regard, the beam strength of the transparency substrate assists in allowing the substrate to reliably slide over the media transport belts 46A, 46B without disturbing the toner on the substrate 36. Since the printer 10 may be operated so as to maximize the fuser speed, e.g., approximately 10 pages per minute in the illustrated example, without changing or varying the speed of the second motor 90 for the second handoff between the media transport belt assembly 46 and the fuser assembly 48, the minimum required inter-page gap can be effectively determined and optimized, thus improving the overall page throughput.

In this regard, it is noted that there may be wow, flutter and other rotational velocity variations in the fuser assembly 48 since the second motor 90 may be required to operate over an excessively wide range of speeds. However, motion quality artifacts are typically introduced during the imaging process and not in the fusing process, thus the second motor 90 can run at the relatively slow fusing speed required for the transparencies and other specialty paper and accept the increased wow and flutter without producing print quality artifacts.

In one illustrative example, a printer 10 comprises a designed-for maximum print speed of 35 pages per minute for color plain paper substrates and a designed-for maximum print speed of 10 pages per minute for color transparencies. During normal printing of plain paper, both the imaging and fusing operations are performed at the maximum 35 pages per minute rate, i.e., the image process rate and the fusing rate are 35 pages per minute. However, the printer 10 further includes at least one mode of operation, e.g., for printing transparencies or other specialty paper, where the operational rate of the fuser assembly 48, i.e., the fusing rate, is lower than the maximum image process rate.

The first and second motors 88, 90 are optimized for operation at the maximum designed-for speed of 35 pages per minute for a first mode of operation, e.g., when printing on plain paper. Thus, when the printer 10 is in a first mode of operation, and is printing on plain paper, the first and second motors 88, 90 are controlled, e.g., by controller 80, so as to operate the image process rate and the fusing rate at the designed-for speed of 35 pages per minute.

Assume for purposes of the present example that the maximum tolerable speed reduction for the first motor 88 is determined to be 3:1. An illustrative embodiment of the present invention comprises operating the imaging process including toned image transfer at the second toner image transfer station 34 at an operating speed no slower than approximately 11.67 pages per minute, which is faster than the 10 pages per minute limit required for color transparencies.

To print a color transparency, the printer 10 utilizes a second mode of operation wherein the controller 80 adjusts the first motor 88 to operate the imaging process of the imaging apparatus, including toned image transfer at the second toner image transfer station 34, at a rate of approximately one half the maximum operating speed of the printer 10, e.g., by setting a control of the imaging process at a ½ speed operational point. Thus, the imaging process is performed at approximately 17.5 pages per minute, which is well within the 3:1 speed range of the imaging apparatus. The substrate 36 is advanced from the substrate supply 42 to the second image transfer station 34 at the ½ speed operational point of 17.5 pages per minute. However, the media transport belt assembly 46 and fuser assembly 48 are operated at substantially 10 pages per minute.

As such, the transparency substrate is slid at the first handoff onto the media transport belts 46A, 46B from the nip of the second image transfer station 34 with a speed mismatch between the second image transfer station 34 and the media transport belt assembly 48. The high beam strength of the transparency material eases the sliding operation and assists the second image transfer station 34 in pushing the transparency onto the media transport belts 46A, 46B despite the speed mismatch between the second image transfer station 34 and the media transport belt assembly 46. Once the transparency exits the second image transfer station 34, the vacuum created by the plenum 52 of the of the media transport belt assembly 46 temporarily tacks the transparency substrate down to the belt surface for transport to the nip of the fuser assembly 48. In this regard, the fan velocity of the plenum 52 or other corresponding attraction force of the media transport belt assembly 46 may be adjusted to allow the necessary slip, e.g., by having a minimal impact on the transparency until the substrate completely exits the second image transfer station 34.

Thus, the second image transfer station 34 is operated at a first speed that remains substantially constant, e.g., the image processing half speed of 17.5 pages per minute, and the media transport belt assembly 46 and the fuser assembly 48 are operated at a second speed that remains substantially constant, e.g., at 10 pages per minute throughout the printing operation.

However, there is now a speed mismatch between the second image transfer station 34 and the media transport belts 46A, 46B, e.g., approximately 7.5 pages per minute in the above example. To compensate for the speed difference, the printer 10 is operated so as to adjust the inter-page gap to a desired print speed, e.g., 10 pages per minute, even thought the image processing components may be operated at the first speed, e.g., approximately 17.5 pages per minute. As the transparency is passed from the second image transfer station 34 to the media transport belt assembly 46, the leading edge of the substrate 36 is allowed to overcome the attraction force, e.g., the vacuum, so as to slip onto the media transport belts 46A, 46B. The above example is only illustrative and other operating speeds and speed mismatches may alternatively be used. For example, the implemented image process rate and fusing rate will likely depend upon factors such as the maximum imaging speed, the maximum fusing speed, the type of print substrate, the range of tolerable motor speeds for the imaging operation, tolerable range of additional printer components such as imaging electronics and/or paper path registration controls, the length of the media transport belts and other factors related to the characteristics of the particular printer and/or substrate.

When slipping the substrate on the media transport belts 46A, 46B, care may be required to avoid skewing the substrate or disturbing the un-fused toner on the substrate surface in a manner that adversely affects print quality. As noted above, the media transport belt assembly 46 provides an attraction force. For example, the exemplary media transport belt assembly 46, which is best seen in FIG. 3, includes a plenum 52 or similar device for drawing a vacuum, which may comprise a fan 53 or other suitable source. According to an embodiment of the present invention, the vacuum pressure is controlled to achieve a desired amount of slippage. This may be accomplished by selectively controlling the fan between on and off states or by other approaches, depending upon the specific implementation of the plenum 52. As such, adjustments can be implemented based upon substrates, for example, depending upon the anticipated beam strength of the substrate, etc. Moreover, the vacuum pressure may be varied throughout the printing operation, e.g., based upon the location of the substrate 36 within the printer 10.

Figure 7:
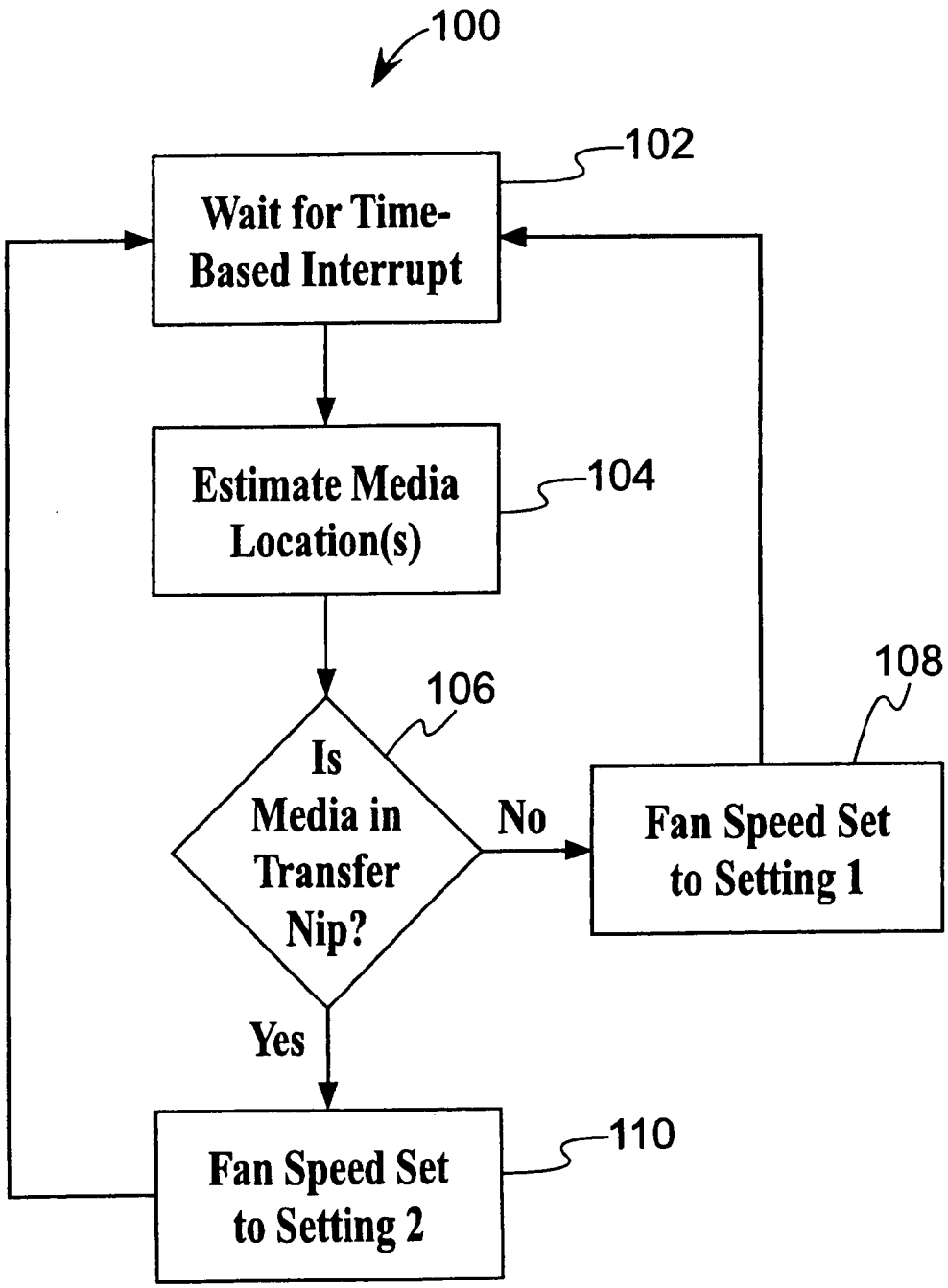
FIG. 7 is a flow chart illustrating one exemplary approach for controlling a vacuum provided by a plenum of a media transport belt assembly for providing a predetermined amount of slip for a particular print substrate.

Referring to FIG. 7, a flow chart illustrates one exemplary control scheme 100 for adjusting the vacuum fan speed. The above control scheme may be implemented for example, by the processor 80 and assumes that a hand off occurs at a speed mismatch. Further, the control scheme 100 assumes that the fan speed has been calibrated based upon a given image process rate, a given fusing rate, and an anticipated substrate type. For example, empirical testing may be used to characterize different fan speed changes for different handoff speed differences, different media types or for other similar considerations.

Initially, the control scheme waits for a time based interrupt at 102, e.g., the initiation or processing of a print job. After receiving the interrupt, the processor may optionally estimate the substrate location(s) at 104, e.g., using a suitable paper path sensor such as the substrate sensing device 41 described with reference to FIG. 2. A decision is made at 106 as to whether the substrate is passing through the nip of the second image transfer station. If there are no substrates in the nip of the second image transfer station, then the fan speed of the fan in the plenum of the image transport belt assembly is optionally set to a first speed setting at 108. If however, a substrate 36 is detected in the nip of the second image transfer station, then the fan speed of the fan in the plenum of the media transport belt is set to a second setting that is different from the first setting at 110.

In this regard, the first setting sets the fan speed to a default speed for the overall print output rate. The second fan speed is set to such that the substrate can overcome the vacuum drawn by the fan in the plenum of the media transport belt so as to slip onto the media transport belts. The difference in the first and second fan speed will depend upon numerous factors such as the beam strength of the substrate, the relative linear speed difference between the second image transfer station and the media transfer belt and similar like parameters such as those described more fully herein.

Although the above description discusses a color printer, the invention may be used with mono printers, copiers, facsimile and other imaging devices. Also, it will be appreciated that other printer configurations having different substrate paths and image processing configurations may be implemented within the spirit of the present invention.

Having described the invention in detail and by reference to preferred embodiments thereof, it will be apparent that modifications and variations are possible without departing from the scope of the invention defined in the appended claims.

What we claim is:

1. An electrophotographic imaging device comprising:

an imaging apparatus for forming a toned image on a substrate including an image transfer station for transferring said toned image from at least one image bearing member to said substrate;

a fuser assembly configured to fuse said toned image to said substrate;

a transport device configured to transport said substrate from said image transfer station to said fuser assembly; and a controller configured to control said image transfer station to operate at an image process rate and to control said transport device to operate at a transport process rate, said controller having a first mode of operation where said image process rate of said image transfer station is different from said transport process rate of said transport device when a handoff is performed to pass said substrate from said image transfer station to said transport device;

wherein said imaging apparatus and said transport device are further configured such that when said handoff is performed and said controller is operating in said first mode of operation, a leading edge of said substrate traveling at least substantially at said image process rate is caused to slip over and onto said transport device, which is operating at the transport process rate different from the image process rate, until said substrate has left a nip area of said image transfer station.

2. The electrophotographic imaging device according to claim 1, wherein said controller is further operatively configured to control said image process rate of said image transfer station to be greater than said transport process rate of said transfer device when said handoff is performed.

3. The electrophotographic imaging device according to claim 1, wherein said controller is operatively configured to control said image process rate of said image transfer station and said transport process rate of said transport device at a speed difference such that said substrate slips at least partially over and onto said transport device when said handoff is performed.

4. The electrophotographic imaging device according to claim 1, wherein said transport device further comprises a plenum for providing an attraction force sufficient to temporarily hold said substrate to a surface of said transport device.

5. The electrophotographic imaging device according to claim 4, wherein said plenum comprises a vacuum source and said controller is further operatively configured to control said vacuum source so as to adjust said attraction force by an amount sufficient to allow said substrate to at least partially slip over and onto said transport device during said handoff.

6. The electrophotographic imaging device according to claim 5, further comprising:

a substrate sensing device located upstream of said transport device, said substrate sensing device arranged to detect a position of said substrate;

wherein said controller is further operatively configured to:

determine whether said substrate is at said image transfer station based upon a detected position of said substrate by said substrate sensing device; and to control said vacuum source so as to adjust said attraction force by a first amount when said substrate is at said image transfer station and by a second amount when said substrate is not at said image transfer station.

7. The electrophotographic imaging device according to claim 1, wherein said controller is operatively configured to:

operate said fuser assembly and said transport device at said transport process rate; and maintain said image process rate and said transport process rate constant during processing by said imaging apparatus and said fuser assembly while said controller is in said first mode of operation.

8. An arrangement for transporting a toned image on a substrate to a fuser assembly in an electrophotographic device comprising:

an image transfer station for transferring a toned image to a substrate at an image process rate;

a fuser assembly configured to fuse said toned image to said substrate;

a transport device configured to transport said substrate from said image transfer station to said fuser assembly at a transport process rate; and a controller configured to control said image process rate of said image transfer device and said transport process rate of said transport device, said controller having a first mode of operation wherein said image process rate is different from said transport process rate when a handoff is performed to pass said substrate from said image transfer station to said transport device;

wherein said imaging transfer station and said transport device are further configured such that when said handoff is performed and said controller is operating in said first mode of operation, a leading edge of said substrate traveling at least substantially at said image process rate is caused to slip over and onto said transport device, which is operating at the transport process rate different from the image process rate, until said substrate has left a nip area of said image transfer station.

9. The arrangement for transporting a toned image on a substrate to a fuser assembly according to claim 8, wherein said controller is further operatively configured to control said image process rate of said image transfer station to be greater than said transport process rate of said transfer device when said handoff is performed.

10. The arrangement for transporting a toned image on a substrate to a fuser assembly according to claim 8, wherein said controller is operatively configured to control said image process rate of said image transfer station and said transport process rate of said transport device at a speed difference such that said substrate slips at least partially over and onto said transport device when a handoff is performed to pass said substrate from said image transfer station to said transport device.

11. The arrangement for transporting a toned image on a substrate to a fuser assembly according to claim 8, wherein said transport device further comprises a plenum for providing an attraction force sufficient to temporarily hold said substrate to a surface of said transport device.

12. The arrangement for transporting a toned image on a substrate to a fuser assembly according to claim 11, wherein said plenum comprises a vacuum source and said controller is further operatively configured to control said vacuum source so as to adjust said attraction force by an amount sufficient to allow said substrate to at least partially slip over and onto said transport device during said handoff.

13. The arrangement for transporting a toned image on a substrate to a fuser assembly according to claim 12, further comprising:

a substrate sensing device located upstream of said transport device, said substrate sensing device arranged to detect a position of said substrate;

wherein said controller is further operatively configured to:

determine whether said substrate is at said image transfer station based upon a detected position of said substrate by said substrate sensing device; and to control said vacuum source so as to adjust said attraction force by a first amount when said substrate is at said image transfer station and by a second amount when said substrate is not at said image transfer station.

14. A method of operating an electrophotographic imaging device comprising:

operating an image transfer station at an image process rate to transfer a toned image to a substrate;

operating a fuser assembly to fuse said toned image to said substrate;

operating a transport device at a transport process rate to transfer said substrate from said image transfer station to said fuser assembly; and operating in a select one of at least two modes of operation;

wherein said image process rate is different from said transport process rate while a handoff is performed to pass said substrate from said image transfer station to said transport device by causing a leading edge of said substrate traveling at least substantially at said image process rate to slip over and onto said transport device, which is operating at the transport process rate different from the image process rate, until said substrate has left a nip area of said image transfer station when operating in a first one of said at least two modes of operation.

15. The method according to claim 14, wherein said handoff occurs by operating said image process rate of said image transfer station at a speed that is greater than a speed of said transport process rate of said transport device.

16. The method according to claim 14, further comprising controlling said image process rate of said image transfer station to be greater than said transport process rate so as to allow said substrate to at least partially slip over and onto said transport device.

17. The method according to claim 16, further comprising:

providing said transport device with a controllable plenum configured to provide an attraction force to said substrate on a surface of said transport device; and controlling said controllable plenum such that said substrate slips over and onto said transport device from said image transfer station and said substrate has stopped slipping on said transport device before reaching said fuser assembly.

18. The method according to claim 14, further comprising:

providing said transport device with a controllable plenum configured to provide an attraction force to said substrate on a surface of said transport device;

determining whether said substrate is at said image transfer station;

controlling said controllable plenum to provide a first attraction force at least when said substrate is at said image transfer station; and controlling said controllable plenum to provide a second attraction force that is different from said first attraction force when said substrate is not at said image transfer station.

19. The method according to claim 14, further comprising operating in said first one of said at least two modes of operation when said substrate is a first type of substrate, and operating in a second mode of operation wherein said first and second process rates are substantially the same when said substrate is a second type of substrate.

20. The method according to claim 14, further comprising:

operating said transport process rate of said transport device at a speed that is slower than a designed-for maximum speed; and operating said image process rate of said image transfer station at a speed that is slower than said designed-for maximum speed but faster than said transport process rate of said fuser assembly.

* * * * *